United States Patent [19]

Stinson et al.

[11] Patent Number: 4,641,715

[45] Date of Patent: Feb. 10, 1987

[54] APPARATUS FOR DRIVING AND RETRACTING GROUND RODS OR THE LIKE

[75] Inventors: Donald B. Stinson; Arthur A. Orofino, both of Farmington, Mich.

[73] Assignee: New Product, Inc., Farmington, Mich.

[21] Appl. No.: 535,042

[22] Filed: Sep. 23, 1983

[51] Int. Cl.[4] ..... B25D 17/06

[52] U.S. Cl. ..... 173/129; 173/90; 173/132

[58] Field of Search ..... 173/90, 92, 29, 47, 173/48, 54, 53, 91, 128, 129, 132, 130, 38, 39; 254/29 R, 30, 31, 106; 227/63, 147

[56] References Cited

U.S. PATENT DOCUMENTS

| | | | |
|---|---|---|---|
| 267,605 | 11/1882 | Sherman | 173/132 |
| 735,205 | 8/1903 | Bunger | 173/129 |
| 891,157 | 6/1908 | Freeman | 173/129 |
| 1,091,336 | 3/1914 | Hill | 173/132 |
| 1,566,631 | 12/1925 | Sturtevant | 173/91 |
| 2,033,227 | 3/1936 | Brown | 173/129 |
| 2,229,364 | 1/1941 | Blackman | 254/29 R |
| 2,330,360 | 9/1943 | Hill | 173/129 |
| 3,015,365 | 1/1962 | Griffin et al. | 173/129 |
| 3,351,141 | 11/1967 | Fowler | 173/38 |
| 3,454,113 | 7/1969 | Holtz | 173/129 |
| 3,499,497 | 3/1970 | Moore | 173/129 |
| 4,277,052 | 7/1981 | Kallinger | 254/106 |

*Primary Examiner*—Donald R. Schran
*Assistant Examiner*—James L. Wolfe
*Attorney, Agent, or Firm*—Reising, Ethington, Barnard, Perry & Milton

[57] ABSTRACT

An apparatus is disclosed for driving or retracting ground rods or other rod-like members and preferably includes an element for forcibly urging a body portion in longitudinal directions generally parallel to the rod or rod-like member being driven or extracted, opposed jaw members slidably connected to the body portion for receiving rod or other item to be driven therebetween, and abutment members fixed to the body portion for forcibly urging the jaw members laterally toward one another into a gripping engagement with the rod, thereby forcibly urging the jaw members and the rod or rod-like member in a driving longitudinal direction. The body portion of the ground rod driving or extracting apparatus is preferably interlockingly connectable to various adapter or anvil apparatus for use with either manual or powered force-applying devices and for interchangeable use with such devices in either rod-driving or rod-retracting operations. The body portion of the apparatus also preferably includes guide and alignment mechanisms for maintaining the jaw members in both longitudinal and lateral alignment with one another as they are urged toward and away from the rod.

15 Claims, 12 Drawing Figures

APPARATUS FOR DRIVING AND RETRACTING GROUND RODS OR THE LIKE

BACKGROUND AND SUMMARY OF THE INVENTION

The invention relates generally to devices or apparatus for urging a ground rod, anchor rod, sign post, pipe, or other such rod-like members, into or out of the ground or other media through which such items are to be forcibly driven or retracted. More specifically, the invention relates to such devices or apparatus having a number of jaw members that grippingly engage the rod or other rod-like member and which preferably include means for imparting the driving or retracting force to the apparatus either manually or by use of power percussion tools or the like.

In the past ground rods, anchor rods, sign posts, and the like, have been driven into the ground or other similar medium by pounding on, or otherwise imparting impact blows on the end of the rod with a sledge hammer or other similar tool. Such methods have proven to be inconvenient and unsafe, especially where the rod or rod-like member is relatively long, because it was necessary for the worker imparting such impact blows to stand on a ladder or other elevated structure in order to be able to reach the top end of the rod with the hammer. In addition, such methods frequently required one or more additional workers to hold the rod in a stable lateral position during the pounding operation. Therefore, in the event of an inaccurate or errant impact blow, injury to the holder frequently resulted. In addition to being unsafe, such methods also made it difficult to avoid bending, nicking, or otherwise damaging the rod, sign post, or other rod-like member.

In light of the disadavntages of the manual pounding method described above, various devices and apparatuses for driving ground rods, sign posts, and the like, have been proposed but have frequently been found to be relatively cumbersome to use, inordinately complex and expensive to manufacture, relatively narrow in their ranges of applications and uses, or largely ineffectual in such driving or extracting operations without causing undue damage to the rod or other similar item. Examples of such prior devices and apparatuses are disclosed in U.S. Pat. Nos. 1,298,379; 2,145,420; 2,033,227; 2,330,360; 2,426,501; 2,693,086; 2,802,340; 3,034,588; 3,425,499; 3,454,113; 3,474,870; 3,499,497; 4,159,040; and British Pat. No. 1,486,581.

In accordance with the present invention, an apparatus is disclosed for driving or retracting ground rods or other rod-like members into or out of the ground or other substrata, or into or out of other media. The apparatus is relatively simple and inexpensive to manufacture, easy to use, and adaptable to both manual and power-operated force-applying devices. Generally speaking, an apparatus according to the present invention preferably includes a body portion, means for forcibly urging the body portion in either first and second longitudinal directions generally parallel to the rod or rod-like member being driven or extracted, at least a pair of jaw members slidably connected to the body portion in an opposed relationship for receiving the rod or other item to be driven therebetween, and abutment members fixed to the body portion for forcibly urging the jaw members laterally toward one another into a gripping engagement with the rod, thereby forcibly urging the jaw members and the rod or rod-like member in a driving first longitudinal direction. The body portion of the apparatus also preferably includes a guide mechanism for forcibly urging the jaw members laterally away from each other when the body portion is moved in a second opposite longitudinal direction in order to disengage the jaw members from the rod in order to remove or reposition the apparatus longitudinally on the rod. Additionally, the apparatus preferably includes an alignment mechanism for maintaining the jaw members at least in longitudinal alignment with one another as they are urged toward and away from the rod.

The body portion of the ground rod driving or extracting apparatus is preferably connectable to various adapter or anvil apparatus for use with either manual or powered force-applying devices and for interchangeable use with such devices in either rod-driving or rod-retracting operations.

Additional advantages, features, and objects of the present invention will become apparent from the following description and the appended claims taken in conjunction with the accompanying drawings.

DETAILED DESCRIPTION OF THE PREFERRED EMBODIMENTS

Figure 1:
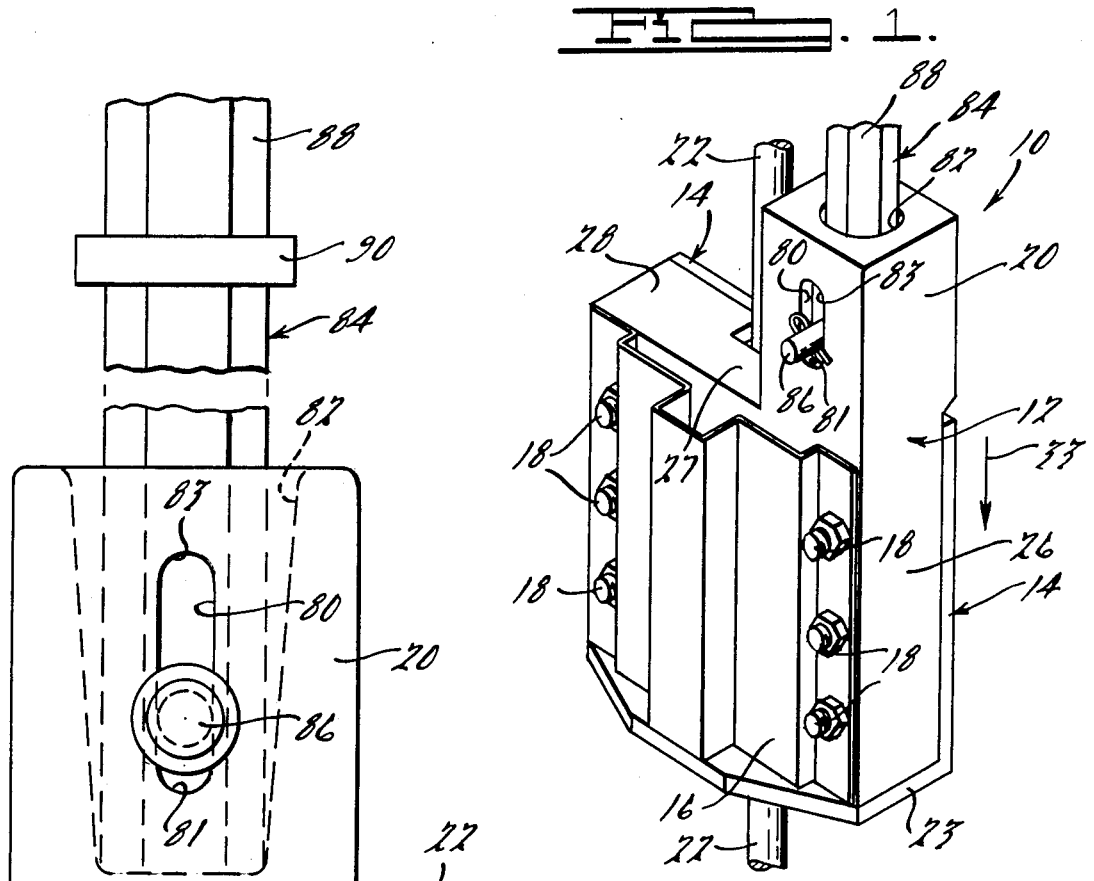
FIG. 1 is an overall perspective view of an apparatus according to the present invention for driving or retracting ground rods or other rod-like members into or out of the earth or other media.

FIGS. 1 through 11 of the drawings illustrate exemplary preferred embodiments of the present invention as applied to a device or apparatus for driving or retracting an electrical ground rod into or out of the earth or other similar media. One skilled in the art will readily recognize from the following discussion, however, that such drawings are for purposes of illustration and that such a device or apparatus according to the principles of the present invention is equally applicable to driving or retracting anchor rods, sign posts, piping, or other similar rod-like items into, out of, or through, the ground or other such media in virtually any vertical, horizontal, or other direction.

As shown in FIGS. 1 through 4, a rod-driving apparatus 10, which is illustrative of one preferred embodiment of the present invention, generally includes a body 12 enclosed by a front face plate 14 and a rear face plate 16, with the face plates secured to the body 12 by means of threaded fasteners 18 or other attachment means known in the art. One or more force-receiving and force-transmitting portions 20 are fixed to, or integrally formed with, the body 12 and are adapted for interlocking connection to various force-applying apparatus (described below) for forcibly urging the body 12 in first and second longitudinal directions generally parallel to a rod 22. Preferably, the front face plate 14 includes a bottom portion 23, which extends generally laterally therefrom and has an aperture 25 therein through which the rod 22 extends.

Figure 2:
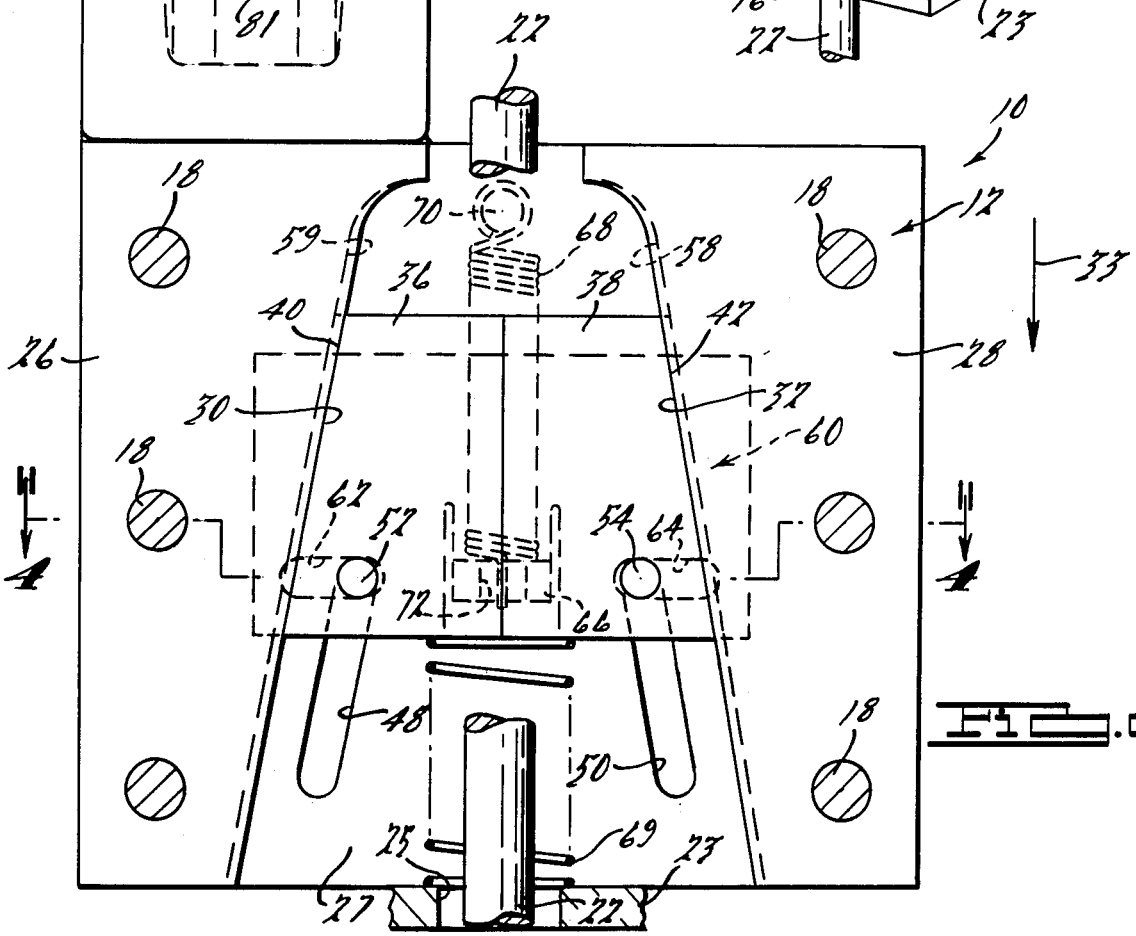
FIG. 2 is a front elevational view of the apparatus of FIG. 1, with its front face plate removed to reveal the internal components thereof.
Figure 3:
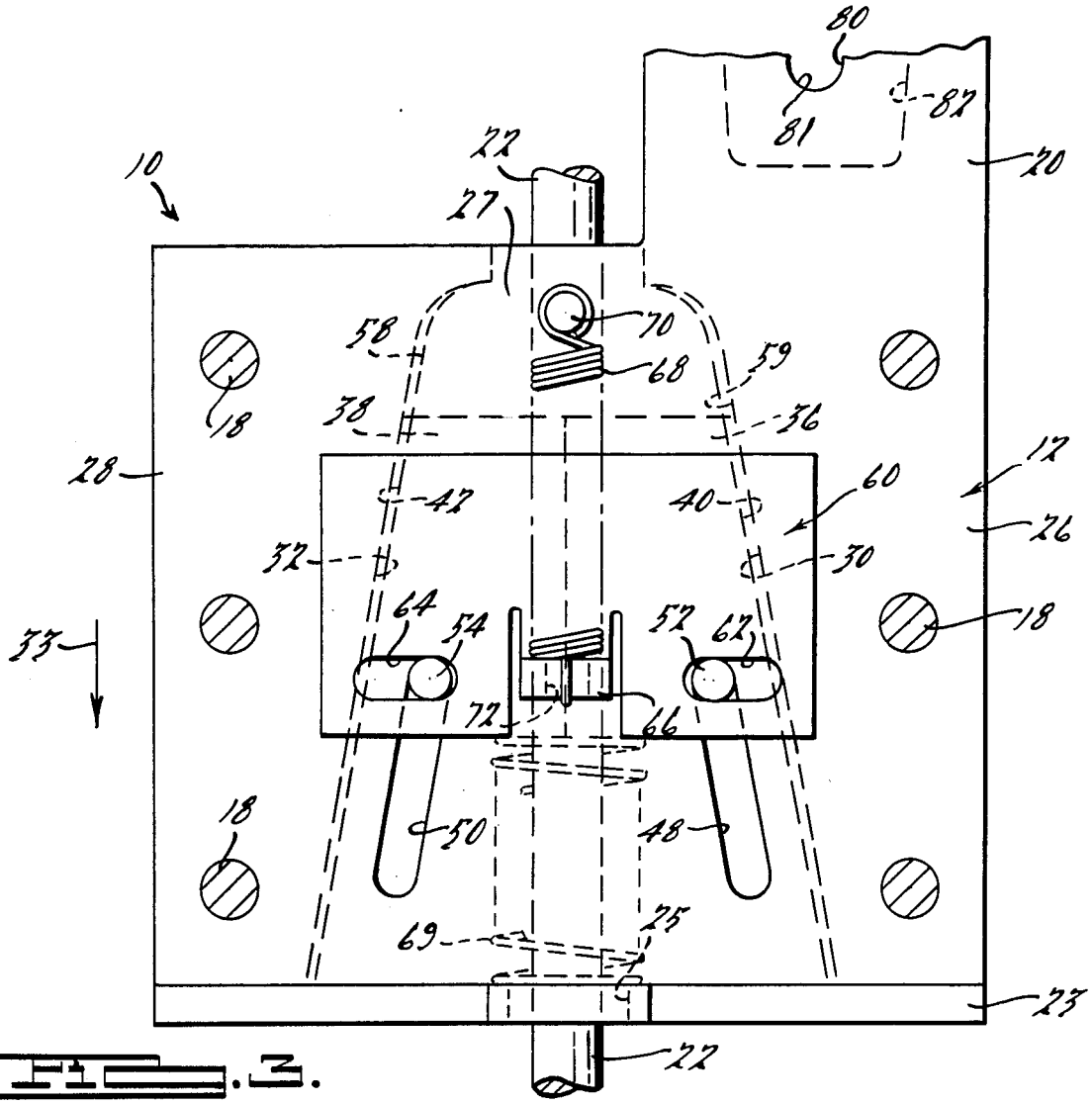
FIG. 3 is a rear elevational view of the apparatus of FIG. 1, with its rear face plate removed to reveal the internal components thereof.

The preferred body 12 is generally U-shaped in lateral cross-section and includes at least a pair of laterally spaced abutment members 26 and 28 fixedly interconnected by at least one guide plate 27 therebetween. The abutment members 26 and 28 preferably include generally inclined abutment surfaces 30 and 32, respectively, facing generally toward one another. The abutment surfaces 30 and 32 preferably diverge laterally relative to one another generally in a first longitudinal direction (denoted by direction arrow 33) parallel to the rod 22, as shown in Figures 2 and 3. At least a pair of jaw members 36 and 38 are slidably received between the respective abutment surfaces 30 and 32 of the abutment members 26 and 28, and are adapted for receiving the rod 22 therebetween. The jaw members 36 and 38 have outer lateral bearing surfaces 40 and 42, respectively, in slidable and abutting engagement with their corresponding adjacent abutment surfaces 30 and 32, and inner rod-gripping surfaces 44 and 46, respectively, for securely but releasably gripping opposed lateral surfaces of the rod 22. Because of the sliding engagement of the inclined bearing surfaces 40 and 42 with their respective inclined abutment surfaces 30 and 32, even a small force on the body 12 in the first longitudinal direction 33 causes the jaw members 36 and 38 to be forcibly urged or wedged in a generally lateral direction toward one another into a gripping engagement with the rod 22. Thus continued force exerted on the body 12 in the first longitudinal direction 33 is transmitted through the abutment members 26 and 28, and through the jaw members 36 and 38, to forcibly urge the rod 22 in the first longitudinal direction 33.

The guide plate 27, which fixedly interconnects the abutment members 26 and 28, preferably includes at least a pair of elongated guide slots 48 and 50 disposed generally adjacent and generally parallel to the abutment surfaces 30 and 32, respectively. As shown in FIGS. 2 and 3, the guide slots 48 and 50 are elongated in directions that laterally diverge relative to one another in the first longitudinal direction 33. Preferably at least a pair of guide pins 52 and 54 protrude from their respective jaw members 36 and 38 and are received for slidable movement in their respective elongated guide slots 48 and 50. Therefore, as the jaw members 36 and 38 are slidably moved along the abutment members 28 and 30, in order to insert and grip the rod-driving apparatus 10 on different rods having different diameters, the jaw members 36 and 38 are maintained in a substantially constant lateral relationship with the abutment members 26 and 28.

Furthermore, after the apparatus 10 has been used to drive or retract a rod a given longitudinal distance and the driving or retracting operation is to be continued, a force can be imparted to the body 12 in a second longitudinal direction (opposite the first longitudinal direction 33) in order to reposition the apparatus 10 on the rod 22. Because of the slidable engagement and cooperation of the guide pins 52 and 54 with the sides of their respective guide slots 48 and 50, such force on the body 12 in the second longitudinal direction causes the jaw members 36 and 38 to be out of engagement with the rod 22. Such disengagement of the jaw members 36 and 38 from the rod 22 facilitates the relative ease of removal or repositioning the apparatus 10 on the rod 22.

The rod-driving apparatus 10 also preferably includes a slide plate 60 slidably disposed and laterally constrained for longitudinal movement between the guide plate 27 and the guide surfaces 17 on the rear face plate 16. The slide plate 60 includes at least one, and preferably a pair of, alignment slots 62 and 64 which are elongated in a generally lateral direction, The guide pins 52 and 54 on the jaw members 36 and 38, respectively, are slidably received within respective alignment slots 62 and 64 for slidable lateral movement therein but are generally restrained from longitudinal movement relative to the slide plate 60. The slide plate 60 thus moves longitudinally relative to the body 12 along with the jaw members 36 and 38, and because of the slidable engagement and cooperation of the guide pins 52 and 54 in the alignment slots 62 and 64, respectively, the jaw members 36 and 38 are maintained in a mutual longitudinal alignment with one another regardless of the movement of the jaw members relative to the body 12. Such mutual longitudinal alignment substantially assures that the rod-gripping surfaces 44 and 46 of the respective jaw members 36 and 38 engage opposite lateral surfaces of the rod 22 at corresponding longitudinal positions thereon, thereby substantially avoiding or minimizing any lateral bending forces from being exerted on the rod 22.

Figure 4:
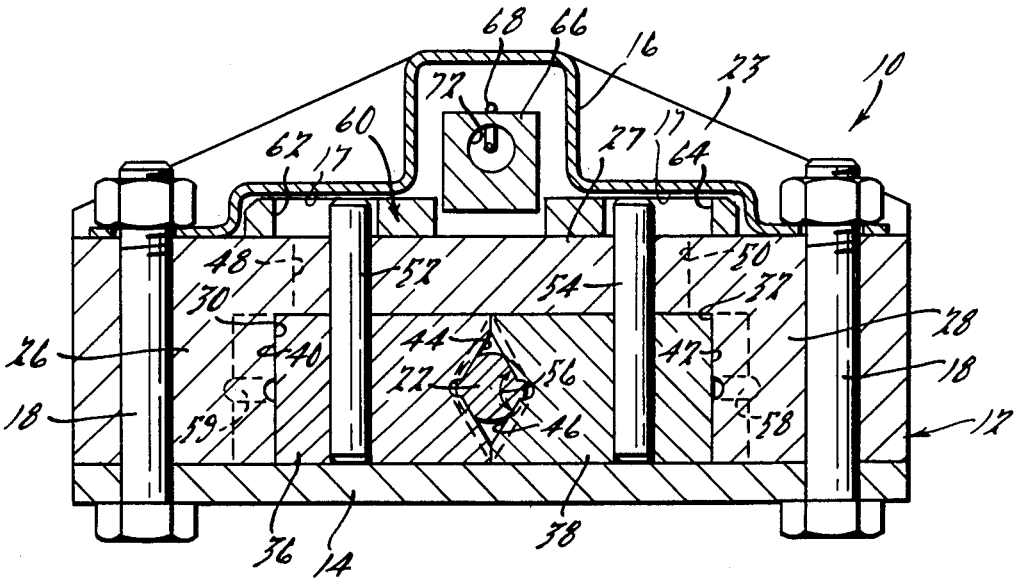
FIG. 4 is a cross-sectional view taken along line 4—4 of FIG. 2.

Besides being maintained in mutual longitudinal alignment with one another by virtue of the guide pins 52 and 54 and the respective alignment slots 62 and 64, the jaw members 36 and 38 are also maintained substantially in a mutually aligned lateral relationship with one another. Such mutual lateral alignment of the jaw members 36 and 38 is preferably accomplished by their freely slidable engagement between the front face plate 14 and the guide plate 27, as is illustrated in FIG. 4. A pair of elongated grooves 58 and 59 are provided in the abutment surfaces 30 and 32, as shown in FIGS. 2 through 4, which provide means for distributing lubricant such as an oil or grease between respective abutting surfaces 30, 40 and 32, 42, as well as providing an area for receiving any dirt which may become lodged between these surfaces so as to avoid interference with the operation of the apparatus.

In order to resiliently bias the jaw members 36 and 38 in the second longitudinal direction relative to the body 12 and thereby aid in their lateral movement and gripping engagement with the rod 22, a resilient spring member 68 is preferably stretched in tension between an aperture 72 in a tab 66 protruding generally outwardly and rearwardly from the slide plate 60 and a pin or other anchor member 70 fixedly connected to the guide plate 27 or other fixed location on the body 12. In addition a relatively heavy compression spring 69 may be provided which engages the bottom portion 23 of the front face plate 14 and both of the jaw members 36 and 38 to further resiliently bias the jaw members in the second longitudinal direction, and thus laterally toward one another. It should be noted that either one of the tension spring member 68 or the compression spring member 69 may optionally be deleted from the apparatus 10 if only one of the spring members is deemed to provide a sufficient and adequate biasing force in a particular application.

Figure 5:
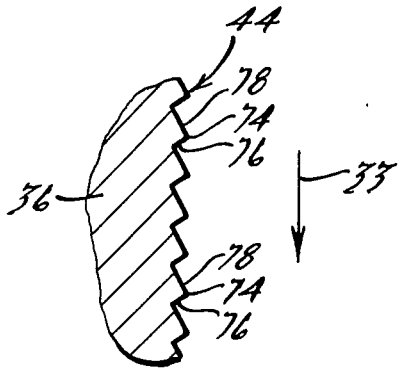
FIG. 5 is an enlarged fragmentary cross-sectional detail view of the rod-gripping surface of the jaw members in one embodiment of the invention.

As mentioned above, the jaw members 36 and 38 include respective rod-gripping surfaces 44 and 46 thereon. As shown in FIG. 5, which is a typical cross-sectional detail of one illustrative embodiment of the jaw members 36 and 38, the rod-gripping surface 44 (or 46) includes a plurality of rod-gripping teeth 74 thereon. Each of the teeth 74 preferably includes a face portion 76 that has a positive rake angle in the first longitudinal direction 33. Such positive rake angle of the fact portions 76 allows for a minimum of undesirable cutting action during the gripping engagement of the jaw members 36 and 38 with the rod 32. Each of the rod-gripping teeth 74 also includes a face portion 78 which also has a positive rake angle in the second opposite longitudinal direction. The positive rake angle of the face portions 78 is preferably larger than the rake angle of the face portions 76 in order to facilitate relative ease and freedom of disengaging action of the teeth 74 with the rod 22 when the body 12 is forcibly urged in the second longitudinal direction.

Furthermore, in order to minimize the undesirable cutting or indentation of the lateral surface of the rod 22, the rod-gripping surfaces 44 and 46 should be relatively long, with the length in a particular application being determined generally by parameters such as the size, shape and material of the rod for which the apparatus 10 is intended to be used, the relative hardness or softness of the medium into which the rod is likely to be driven or retracted, and the forces to be exerted by the jaw members on the rod in a given range of applications and uses, as well as other parameters determinable by those skilled in the art from the teachings herein. It should be noted that as an option to the rod-gripping teeth 74 shown in FIG. 5, either flatter teeth or generally planar rod-gripping surfaces (optionally having a friction-enhancing material or coating thereon) may alternatively be employed on the jaw members 36 and 38. As still another option, the jaw members 36 and 38 can be configured to receive a number of different removable and interchangeable rod-gripping insert plates adapted to be fixedly attached thereto. Such insert plates would provide for a variety of optionally interchangeable rod-gripping surface types, i.e., teeth, smooth flat surfaces, flat surfaces with a friction-enhancing material or other rod-gripping surface configurations suitable for a given application.

It should also be noted, as best seen with reference to FIG. 4, that the rod gripping surfaces 44 and 46 are preferably each comprised of a pair of generally laterally extending straight segments which are disposed at an obtuse included angle 56 with respect to each other. Thus each segment will provide an area of contact with the rod which extends over the longitudinal length of the jaw members. The relative angulation of these segments will be selected in order to accommodate a relatively wide range of rod diameters while still providing a secure gripping engagement therewith. It has been found, for example, that an included angle 56 of approximately 120° between segments is particularly well-suited for rods having diameters between approximately ½ inch and approximately ⅞ inch.

As mentioned above, the body 12 preferably includes one or more force-receiving and force-transmitting portions 20 fixedly connected thereto or integrally formed therewith and adapted to be interlockingly connected with a force-applying apparatus. In the preferred body 12 illustrated in FIGS. 1 through 4, the force-receiving and force-transmitting portion 20 preferably includes a generally longitudinally extending anvil slot 80, and a recess or cavity 82 adapted for receiving an anvil member 84 therein. The anvil slot 80 is preferably elongated in a generally longitudinal direction and is adapted to slidably receive an anvil pin 86 for longitudinal movement therein. The anvil pin 86 protrudes generally laterally from the anvil member 84 such that forces exerted on the anvil member 84 are transmitted through the force-transmitting portion 20 to the body 12 in the first longitudinal direction 33 when the anvil pin 86 is located generally at or toward the first longitudinal end 81 of the anvil slot 80. Conversely, forces exerted on the anvil member 84 in the second opposite longitudinal direction are transmitted through the force-transmitting portion 20 to the body 12 in the second longitudinal direction when the anvil pin 86 is located generally at or toward the second longitudinal end 83 of the anvil slot 80. Because the anvil slot 80 is longitudinally elongated, and anvil member 84 may be rapidly and forcibly slid in the second longitudinal direction against the second longitudinal end 83 in order to exert an initial impact force, or shock load, on the force-transmitting portion 20, thereby forcibly urging or "jerking" the teech 74 of the jaw members 36 and 38 free from their gripping engagement with the rod 22. Such impact force thus facilitates the relatively easy and free disengagement of the jaw teeth when the rod-driving apparatus 10 is to be removed or repositioned on the rod 22.

In one preferred version of the present invention, the anvil member 84 includes a shank portion 88 and a collar portion 90 (shown in FIG. 2) adapted for operatively connecting the anvil member 84 to a conventional power percussion tool 94 (shown in FIGS. 6 and 7) in order to forcibly urge the body 12 at least in the first longitudinal direction 33. The power percussion tool 94 may alternatively comprise a pneumatic impact hammer, an electric impact hammer, a hydraulic impact hammer, or other conventional powered percussion or force-applying tools known to those skilled in the art.

Figure 6:
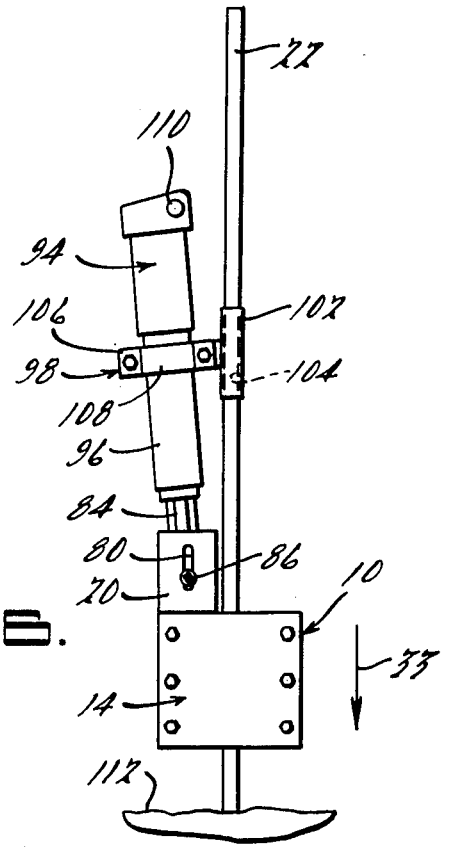
FIG. 6 is an elevational view of the preferred apparatus of FIGS. 1 through 4, illustrated with a conventional power percussion tool connected thereto.

Optionally, if desired, the power percussion tool 94 and the rod 22 may be equipped with an exemplary rod-guide bracket assembly 98 as shown in FIG. 6. The rod-guide bracket assembly 98 preferably includes a first portion 102 having a rod-guide opening 104 extending generally longitudinally therethrough for slidably receiving the rod 22 therein. A second portion 106 is connected to the first portion 102 and includes a connector assembly 108, which is adapted for clamping attachment or connection to a body portion 96 of the power percussion tool 94. One skilled in the art will readily recognize that the particular configuration of the connector assembly 108 depends upon the type and configuration of percussion tool to which it is to be connected.

The rod-guide bracket assembly 98 functions to maintain the rod 22 generally in a longitudinally movable, but laterally fixed, relationship with the power percussion tool 94. Preferably, the first and second portions 102 and 106 of the rod-guide bracket assembly 98 are pivotally interconnected with one another in order to allow selective adjustment of the longitudinal angular relationship between the rod 22 and the power percussion tool 94, such as by charging the relative positioning of the connector assembly 108 with respect to the body portion 96 of the tool 94. The angular relationship can be selected so that the power percussion tool is parallel with, or at an acute angle with respect to, the rod 22 in order to provide space for the operator or worker to grasp the handles 110 of the power percussion tool 94 without interfering with the longitudinal travel of the rod 22.

Figure 7A:
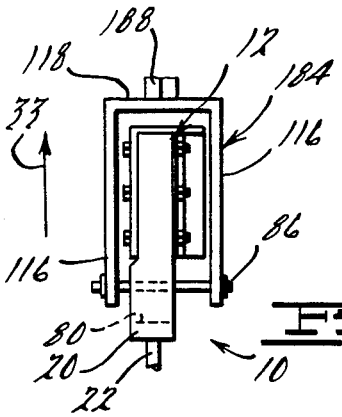
FIG. 7A is a partial elevational view taken along line 7A—7A of FIG. 7.
Figure 7:
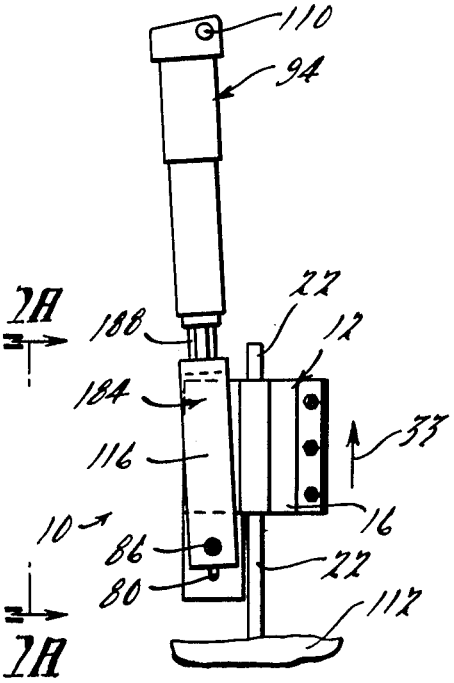
FIG. 7 is an elevational view of the preferred apparatus of FIGS. 1 through 4, in a reversed orientation for retracting a rod or other rod-like member from the ground or other medium.

As illustrated in FIGS. 7 and 7A, an alternate anvil member 184 can be operatively connected to the force-transmitting portion 20 of the body 12 in order to retract a previously-driven rod 22 from the ground 112 or other medium. The anvil member 184 shown in FIG. 7 and 7A preferably comprises a generally U-shaped bracket having a pair of spaced-apart leg portions 116 rigidly interconnected by a base portion 118. The anvil member 184 is adapted to be positioned on the apparatus 10 with the body 12 disposed therebetween, with the leg portions 116 extending generally longitudinally from the base portion 118 on opposite faces of the body 12 toward the force-transmitting portion 20. The anvil pin 86 extends through at least, one, and preferably both, of the leg portions 116 and is slidably received within the anvil slot 80. A shank portion 188 is fixed to the base portion 118 and includes a collar portion, similar to that illustrated in FIG. 1 for the anvil member 84, so as to be operatively connectable to the power percussion tool 94.

It should be noted that FIGS. 7 and 7A illustrate the rod-driving apparatus 10 in a reversed orientation relative to the rod 22 such that the first longitudinal direction 33 is a generally upward (or outward) direction relative to the ground 112. Thus, the power percussion tool 94 may be used in connection with the anvil member 184 for forcibly pulling or urging the body 12 in an upward or outward first longitudinal direction 33 in order to retract the rod 22 from the ground 112.

Figure 8:
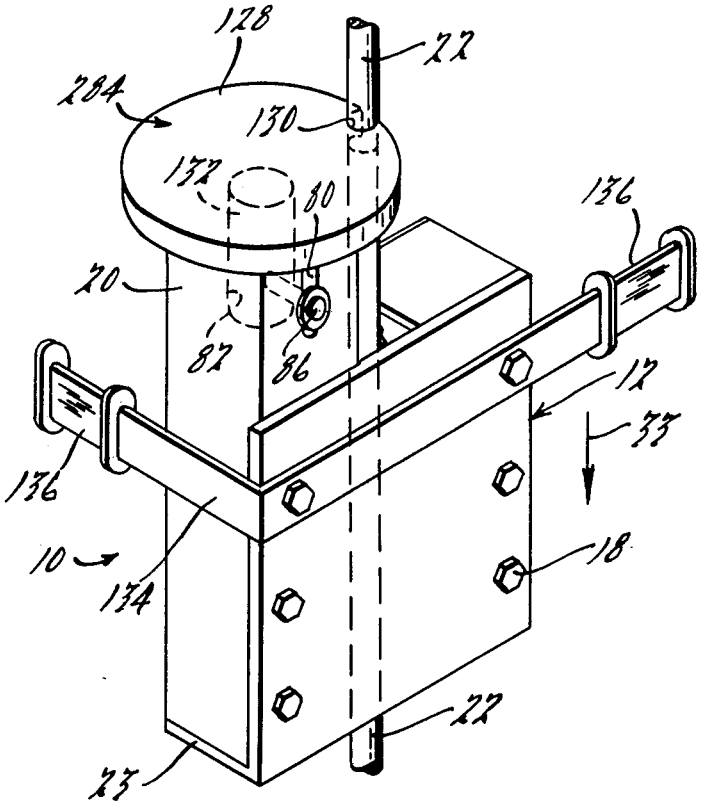
FIG. 8 is a perspective view of the apparatus of FIGS. 1 through 4, including an adapter apparatus for manual rod-driving operations.

FIG. 8 illustrates an alternate anvil member 284 for use in manual rod-driving operations. The anvil member 284 preferably includes a generally planar impact plate 128 having a rod-guide opening 130 therein for receiving the rod 22 in a longitudinally slidable relationship therewith. An anvil post 132 protrudes longitudinally from the impact plate 128 and is adapted to be received within the cavity 82 of the force-transmitting portion 20 with the anvil pin 86 protruding therefrom and slidably extending through the anvil slot 80. The impact plate 128 is adapted to receive impact forces or blows exerted thereon by a sledge hammer or other impact instrument, and to transmit these forces through the force-transmitting portion 20 into the body 12 in order to forcibly drive the rod 22 in the first longitudinal direction 33.

The rod-driving apparatus 10, as depicted in FIG. 8, also preferably includes an angle bracket 134 having a pair of handle members 136 on its outer ends. The angle bracket 134 is fixedly secured to the body 12 so that the rod-driving apparatus 10 may be easily moved in the second opposite longitudinal direction to be removed from the rod 22 or to be repositioned on the rod 22 for further driving operations.

Figure 9:
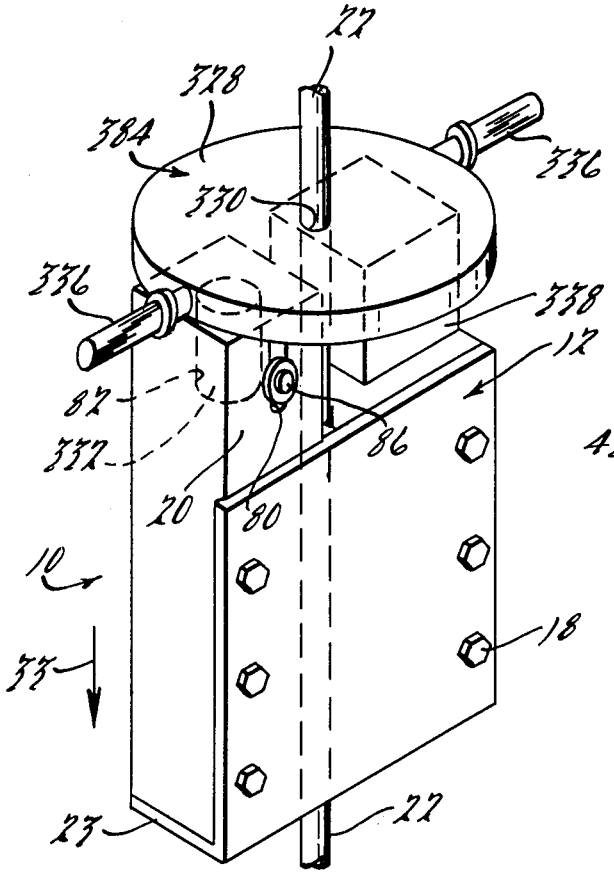
FIG. 9 is a perspective view of the preferred apparatus of FIGS. 1 through 4, including an alternate adapter apparatus for manual rod-driving operations.

In FIG. 9, an alternate adapted apparatus for manual rod-driving operations is illustrated. The alternate anvil member 384 includes an impact plate 328 having a rod-guide opening 330 extending therethrough for slidably receiving the rod 22 therein. The anvil member 384 also includes an anvil post 332, which extends generally longitudinally from the impact plate 128 and is adapted to be received within the cavity 82 of the force-transmitting portion 20. The anvil pin 86 protrudes laterally from the anvil post 332 and is slidably received in the anvil slot 80, as is described above in connection with FIG. 8. The alternate anvil member 384 also preferably includes a load distribution portion 338 which abuttingly engages a relatively large surface area of the body 12 in order to distribute the longitudinal driving forces exerted on the body 12 on both lateral sides of the rod 22.

At least one, and preferably two, handle members 336 are fixedly connected to, or integrally formed with, the impact plate 328 for moving the rod-driving apparatus 10 in the second longitudinal direction during removal or repositioning thereof. Such handle members 336 can also be used to impose impact or shock forces on the body 12 in the second longitudinal direction in order to release or disengage the jaw members from the rod 22 as is described above.

Figure 10:
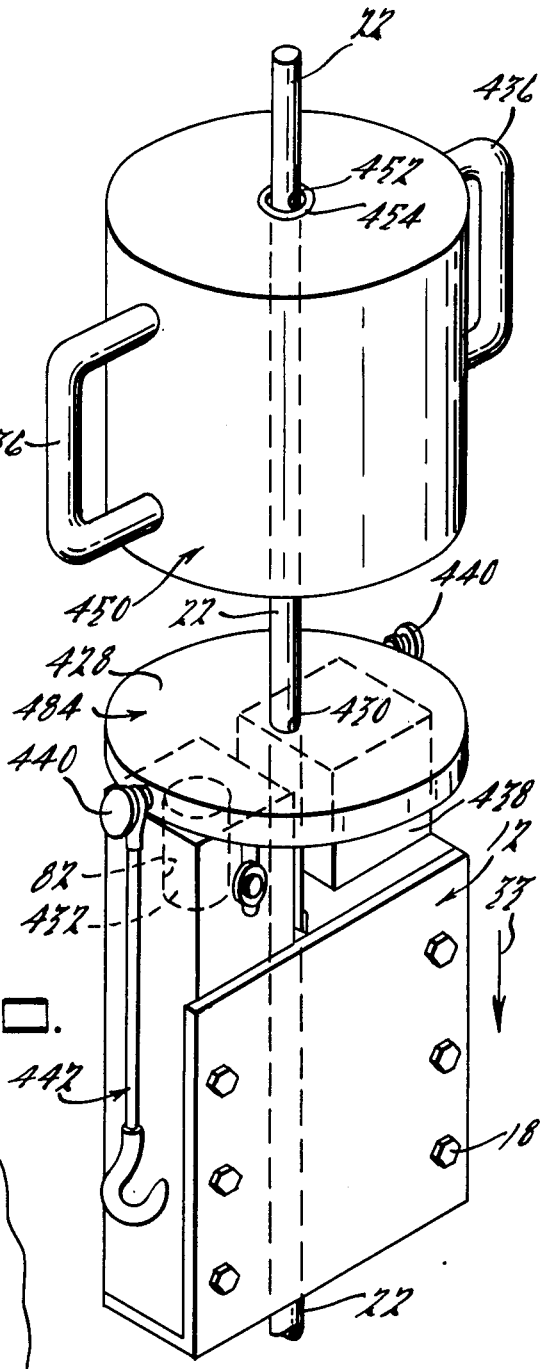
FIG. 10 is a perspective view of the preferred apparatus of FIGS. 1 through 4, including still another adapter apparatus for manual rod-driving or rod-retracting operations.

In FIG. 10, the rod-driving apparatus 10 is shown equipped with an alternate anvil member 484, which is a modified version of the anvil member 384 of FIG. 9. The anvil member 484 preferably includes a generally planar impact plate 428 having an anvil post 432 and a load distribution portion 438 thereon, which are similar to the anvil post 332 and the load distribution portion 338 shown in FIG. 9. The impact plate 428 extends lateraly around a rod-guide opening 430 therein, which slidably receives the rod 22 therethrough.

A weighted force-applying member 450 in FIG. 10 includes an aperture 452 extending longitudinally therethrough, with an antifriction material 454 on its inner wall for slidably surrounding the rod 22. At least one, and preferably two, handle members 436 are rigidly connected to the force-applying member 450 in order to allow the force-applying member to be forcibly slid longitudinally on the rod 22 so as to forcibly urge the body 12, and thus the rod 22, in the first longitudinal direction 33. In order to remove or reposition the apparatus 10, the anvil member 484 also includes at least one stud 440 with a connector assembly 442 thereon. The connector assembly, which preferably includes a hook and flexible cable assembly pivotally attached to one or both of the studs 440, is releasably connectable with the handle members 436 so that the force-applying member 450 can be used to forcibly urge the body 12 in the second opposite longitudinal direction for disengaging the jaw members and for removing or repositioning the apparatus 10 as is explained below. It should be noted that because of the sliding connection provided by the pin and slot, rapid upward movement of the force applying member 450 will subject the body 12 to a sudden shock or jerking action to aid in releasing the engagement of the jaw members with the rod being driven. It also should be noted that the force-applying member 450 may also alternately be employed, in place of a sledge hammer, with the anvil member 384 shown in FIG. 9, in which case the connector assembly 442 (or other connector means) may be pivotally attached to one or both of the handle members 336 for releasable connection with the handle members 436.

Figure 11:
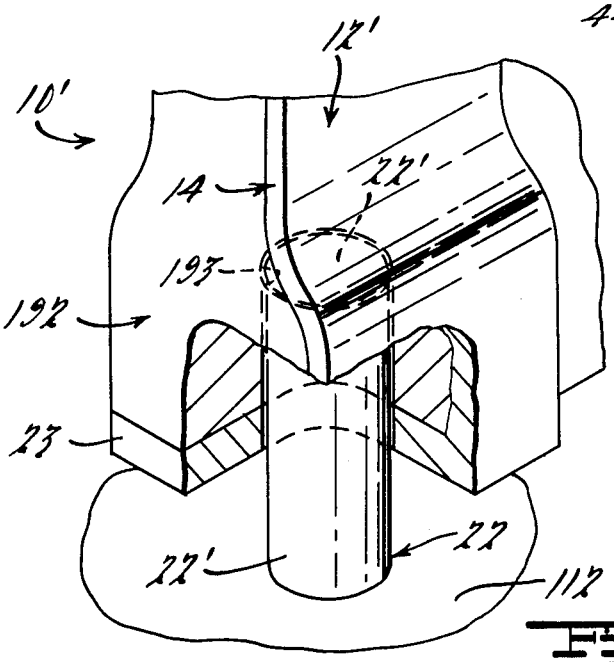
FIG. 11 is a perspective view of an optional alternate embodiment of the apparatus of FIGS. 1 through 4.

FIG. 11 illustrates an alternate embodiment of the rod-driving apparatus 10, in which the body 12' includes an enlarged portion 192 with a blind aperture 193 therein. Once the rod 22 has been nearly fully driven into the ground or other medium, the jaw members of the apparatus 10' can no longer grip the relatively short end portion 22' of the rod 22 protruding from the ground 112 so that the rod can be driven further. In such a case, the body 12' is removed and the rod end portion 22' is inserted into the blind aperture 193 so that the apparatus 10' can be used to continue to forcibly urge the rod 22 in the first longitudinal direction 33 to a desired level above the ground. It should be noted that the alternate apparatus 10' shown in FIG. 11 can be employed with any of the previously-described embodiments of the invention shown for purposes of illustration in the preceding FIGS. 1 through 10.

The foregoing discussion discloses and describes exemplary embodiments of the present invention. One skilled in the art will readily recognize from such discussion that the various changes, modifications and variations may be made therein without departing from the spirit and scope of the invention as defined in the following claims.

We claim:

1. An apparatus for forcibly driving or retracting an elongated rod-like member into or out of the ground or the like, said apparatus comprising:

a body including top and bottom force receiving portions for receiving force exerted directly on said body from longitudinally above or below said body; said body including a pair of spaced interconnected abutment members, each of said abutment members having flat internal abutment surfaces angled upwardly so as to converge towards each other from said bottom portion and curving towards each other below said top portion;

a pair of jaw members slidably retained between said abutment surfaces and directly below said top force receiving surface, both of said jaws having a rod enaging surface facing the other of said jaw members and an outer bearing surface angled upwardly from said bottom portion and converging toward each other, the bearing surfaces being in sliding engagement with said abutment surfaces whereby force applied to said top prorion of said body urges said abutment surfaces over said bearing surfaces of said jaws to force said rod engaging surface against a rod and directly transfer the force thereto;

guide means connected to said body and said jaws for separating said jaw members as said body is forcibly urged upwardly; said guide means including a guide member having a pair of guide slots upwardly angling toward each other, each of said jaws including a projection extending into a respective one of said guide slots to cooperate upon upward movement of said body to separate said rod engaging surfaces of said jaw members;

a slide plate slidably movable relative to said body in said upward and downward longitudinal directions and having at least one generally laterally elongated alignment slot therein, each of said guide members being slidably received in one of said alignment slots for generally lateral movement therein but generally restrained from longitudinal movement relative thereto, said slide plate thereby maintaining said jaw members in said mutual longitudinal alignment;

first resilient biasing means connected to said body and to said slide plate for biasing said jaw members generally in said upward longitudinal direction relative to said body and generally laterally toward one another; and second resilient biasing means connected to said body and connected with said jaw members for resiliently biasing said jaw members generally in said upward longitudinal direction relative to said body and generally laterally toward one another.

2. An apparatus according to claim 1, wherein said rod-gripping surfaces each include a plurality of jaw teeth thereon, said jaw teeth having positive first rake angles relative to said first longitudinal direction.

3. An apparatus according to claim 2, wherein said jaw teeth also have positive second rake angles relative to said second longitudinal direction, said second rake angles being larger than said first rake angles, thereby facilitating relatively free disengagement of said jaw teeth from said rod-like member as said body and said jaw members are forcibly urged in said second longitudinal direction.

4. An apparatus according to claim 1, wherein each of said pair of surfaces are generally straight in a lateral direction and form an obtuse included angle therebetween, said angle being selected so as to enable said surfaces to grip a wide range of sizes of rod like members.

5. An apparatus according to claim 1, including means for forcibly urging said body in said longitudinal directions, said forcibly urging means including means for imparting an initial impact force to said body at least in said second longitudinal direction, said impact force in said second longitudinal direction thereby facilitating relatively free disengagement of said jaw members from said rod-like member.

6. An apparatus according to claim 1, further comprising adapter means for operatively connecting a conventional power percussion tool to said body in order to forcibly urge said body at least in said first longitudinal direction.

7. An apparatus according to claim 6, further comprising reversing means for operatively connecting said conventional power percussion tool to said body when said body is longitudinally reversed on said rod-like member in order to forcibly retract said rod-like member as said body is urged in said first longitudinal direction.

8. An apparatus according to claim 1, wherein said anvil member includes a shank portion thereon adapted for operative connection to a conventional power percussion tool.

9. An apparatus according to claim 8, further comprising a rod-guide bracket including a first portion having a rod-guide opening extending generally longitudinally therethrough for slidably receiving said rod-like member therein, said rod-guide bracket further including a second portion having connector means thereon for connecting said bracket to a body portion of said power percussion tool, said bracket maintaining said rod-like member generally in a longitudinally movable but laterally fixed position relative to said power percussion tool.

10. An apparatus according to claim 9, wherein said first and second portions of said rod-guide bracket are pivotally interconnected in order to selectively adjust the angular relationship between said rod-like member and said power percussion tool, said rod-guide bracket further including locking means for releasably fixing said first and second portions in a pre-selected angular relationship between said rod-like member and said power percussion tool.

11. An apparatus according to claim 8, wherein said anvil member includes a generally U-shaped bracket having a pair of spaced-apart leg portions interconnected by a base portion, said leg portions being adapted to receive said body therebetween with said leg portions extending from said base portion generally in said second longitudinal direction relative to said body, said anvil pin protruding from at least one of said leg portions and being received in said anvil slot, said shank portion protruding from said base portion generally in said first longitudinal direction relative to said body, whereby said power percussion tool may be used to pullingly urge said body in said first longitudinal direction in order to retract said rod-like member from the ground or the like.

12. An apparatus according to claim 8, wherein said anvil member includes an impact plate adapted for receiving impact forces thereagainst, said anvil member further including rod-engaging means for maintaining said longitudinally-extending rod-like member generally in a longitudinally movable but laterally fixed position relative to said anvil member.

13. An apparatus according to claim 12, further comprising handle means for manually urging said body in at least said second direction, thereby allowing said apparatus to be longitudinally repositioned relative to said rod-like member.

14. An apparatus according to claim 12, further comprising an impact tool having a rod-receiving aperture extending longitudinally therethrough, said impact tool being manually slidable in said longitudinal directions on said rod-like member into and out of impact engagement with said impact plate, thereby transmitting forces through said anvil member to said body in at least said first longitudinal direction.

15. An apparatus according to claim 14, wherein said anvil member includes connector means thereon adapted for connection with said impact tool in order to impart an initial impact force on said anvil member and said body at least in said second longitudinal direction, said initial impact force in said second longitudinal direction thereby facilitating relatively free disengagement of said jaw members from said rod-like member.

* * * * *